US005239841A

United States Patent [19]

Zwart

[11] Patent Number: 5,239,841

[45] Date of Patent: * Aug. 31, 1993

[54] METHOD OF DECORATING A HUMAN BREAST

[76] Inventor: Hans Zwart, 214 Northview, Dayton, Ohio 45419

[ * ] Notice: The portion of the term of this patent subsequent to Jan. 29, 2008 has been disclaimed.

[21] Appl. No.: 906,071

[22] Filed: Jun. 29, 1992

Related U.S. Application Data

[60] Division of Ser. No. 631,166, Dec. 20, 1990, Pat. No. 5,125,244, which is a continuation-in-part of Ser. No. 503,728, Apr. 3, 1990, Pat. No. 4,987,667, which is a continuation of Ser. No. 321,696, Mar. 10, 1989, abandoned.

[51] Int. Cl.[5] ..... A44C 25/00

[52] U.S. Cl. ..... 63/2

[58] Field of Search ..... 63/1.1, 2, 14.1, 14.3, 63/14.5, 14.8, 29.1, 13

[56] References Cited

U.S. PATENT DOCUMENTS

| | | | |
|---|---|---|---|
| D. 264,060 | 4/1982 | Epstein | 63/13 X |
| 759,045 | 5/1904 | Tracy | 63/2 X |
| 1,684,783 | 9/1928 | Spear | 63/14.8 |
| 2,383,448 | 8/1945 | Christy | 63/14.8 |
| 2,524,562 | 2/1950 | Dawbarn | 24/27 X |
| 2,849,770 | 9/1958 | Klanchik | 24/27 |
| 3,131,444 | 5/1964 | Manning | 24/27 |
| 3,975,921 | 8/1976 | Pomaski | 63/13 |
| 4,041,931 | 8/1977 | Elliott et al. | 24/27 X |
| 4,099,298 | 7/1978 | Gimenez | 24/27 |
| 4,107,824 | 8/1978 | Lussuir | 24/27 |
| 4,282,721 | 8/1981 | Roach et al. | 63/14.1 |
| 4,625,526 | 12/1986 | Milawski | 63/2 |
| 4,783,974 | 11/1988 | Hernandez | 63/2 |
| 4,803,852 | 2/1989 | Waldron | 63/13 |
| 4,827,738 | 5/1989 | Rothal | 63/14.1 |
| 4,840,045 | 6/1989 | Moody | 63/14.5 |

FOREIGN PATENT DOCUMENTS

| | | | |
|---|---|---|---|
| 227570 | 6/1959 | Austria | 63/14.8 |
| 867537 | 2/1957 | Fed. Rep. of Germany | 24/551 |
| 817942 | 8/1956 | United Kingdom | 63/14.8 |

*Primary Examiner*—Peter M. Cuomo
*Assistant Examiner*—Jerry Redman
*Attorney, Agent, or Firm*—Jacox & Meckstroth

[57] ABSTRACT

A spring wire or other spring-like material is formed with a circular ring portion which has a diameter adapted to fit snugly around a nipple of a human breast. The wire or material also forms two overlapping end portions which project outwardly from the ring portion and are compressed together to enlarge the ring portion so that it may be conveniently placed on the nipple and removed from the nipple. When the end portions are released, the ring portion grips the peripheral surface of the nipple. Preferably, the end portions comprise smaller circular rings which may be used to support different forms of jewelry, and the ring portion may also support a decorative element which covers the nipple. The ring portion and end portions are decorated, preferably by plating with a precious metal.

4 Claims, 2 Drawing Sheets

METHOD OF DECORATING A HUMAN BREAST

RELATED APPLICATIONS

This application is a division of application Ser. No. 631,166, Filed Dec. 20, 1990, U.S. Pat. No. 5,125,244, which is a continuation-in-part of application Ser. No. 503,728, Filed Apr. 3, 1990, U.S. Pat. No. 4,987,667, which is a continuation of Ser. No. 321,696, filed Mar. 10, 1989, abandoned.

BACKGROUND OF THE INVENTION

Humans have been decorating their nipples from time immemorial by attaching decorative items or jewelry. A common attachment method is to pierce each nipple and then insert a thread in the pierced hole. However, few individuals today are willing to undergo such treatment just to wear jewelry. Moreover, there are few facilities where one can have nipples pierced safely. In addition, once the nipple is pierced, a retaining device has to be worn at all times since a nipple perforation can heal within twenty four hours if left open. Such retaining devices may not be desirable at certain times, and the danger of infection is another serious drawback. Furthermore, if the retaining device is a ring worn in the pierced nipple, the ring may get caught and cause serious harm to the wearer.

U.S. Pat. No. 4,625,526 discloses a nipple decoration device which is similar to an earring and includes a pair of opposing spring biased pads for engaging opposite sides of a nipple. In addition, all of the references cited in U.S. Pat. No. 4,625,426 relate to pressure pad earrings. The major disadvantage of this decorative device, which hangs from the nipple, is that the device relies on opposing pressure pads for attachment. However, the nipple, unlike the earlobe, can change considerably in size and consistency due to temperature, sexual excitation, etc. This may result in such a decorative device being inadvertently detached and lost. In addition, the opposing pressure pads would not likely be comfortable for the wearer.

SUMMARY OF THE INVENTION

The present invention is directed to a nipple ring article for decorating a human breast and which fits snugly around the nipple and includes two outwardly projecting end portions. When the end portions are squeezed or compressed together, the diameter and circumference of the nipple ring enlarge so that the ring may be conveniently placed on the nipple. When the pressure is removed from the two end portions, the nipple ring reduces in diameter and snugly grips the nipple. The two end portions of the nipple ring may be provided with means for attaching decorative jewelry which may depend from the nipple ring or be supported in front of the ring. The nipple ring may also be used to attach a decorative material or item which covers the nipple and the immediate surrounding area so that the ring may be used in jurisdictions where females are not permitted to expose their breasts. In most of those jurisdictions, as long as the nipples are not visible, the breasts are not considered to be exposed.

It is therefore primary objects of this invention to provide a decorative nipple ring which fits snugly around a human breast nipple and which may be quickly and easily mounted on the nipple and removed from the nipple. It is also an object of this invention to provide such a nipple ring which may be used to support decorative jewelry.

Other features and advantages of the invention will be apparent from the following description, the accompanying drawings and the appended claims.

DESCRIPTION OF THE PREFERRED EMBODIMENTS

Figure 1:
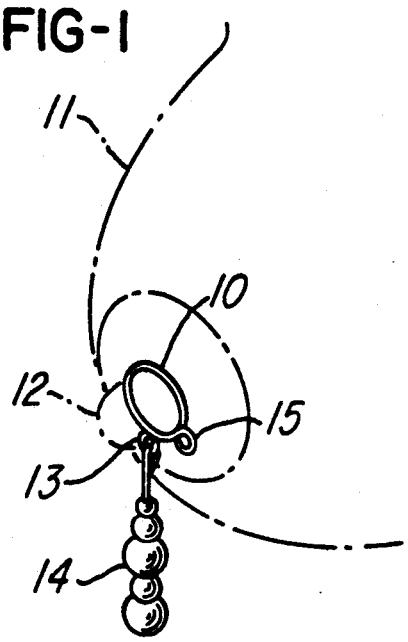
FIG. 1 is a perspective view of a nipple ring constructed in accordance with the invention and positioned on a nipple shown in phantom with a decorative jewelry item depending from one end portion of the ring.
Figure 2:
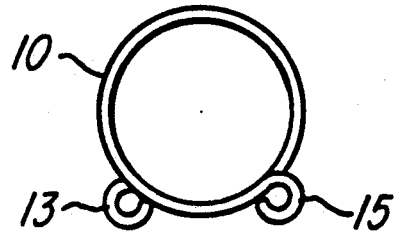
FIG. 2 is an enlarged axial view of the ring shown in FIG. 1.
Figure 3:
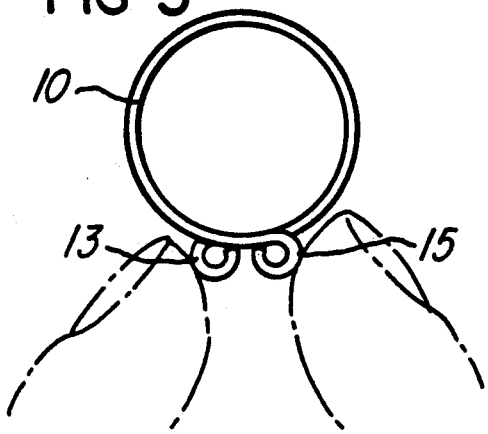
FIG. 3 is a view similar to FIG. 2 and showing the ring expanded prior to being placed on a nipple.
Figure 4:
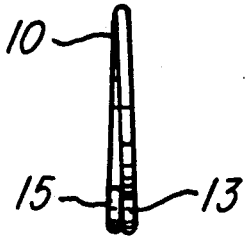
FIG. 4 is a side elevational view of the ring shown in FIG. 2.

Referring to FIG. 1, a circular nipple ring 10 is constructed of spring steel music wire and mounts on a human breast 11 surrounding a nipple 12, as shown in phantom. The nipple ring 10 is decorated, for example, by a gold or silver plating, and has opposite and overlapping end portions 13 and 15 which are in the form of small circular rings. The end portion 13 supports a decorative jewelry item 14 in the form of a set of pearls or beads. In FIG. 3, the circular end portions 13 and 15 are shown squeezed or compressed together to enlarge the diameter and circumference of the ring 10 so that the ring 10 may be easily placed over the nipple 12. When the pressure on the circular end portions 13 and 15 is released, the ring 10 will return to its normal position as shown in FIG. 2 where the ring snugly grips the peripheral surface of the nipple 12. Preferably, the rings are made in a series of different sizes which range in diameter from about 5 mm. to about 13 mm.

Figure 5:
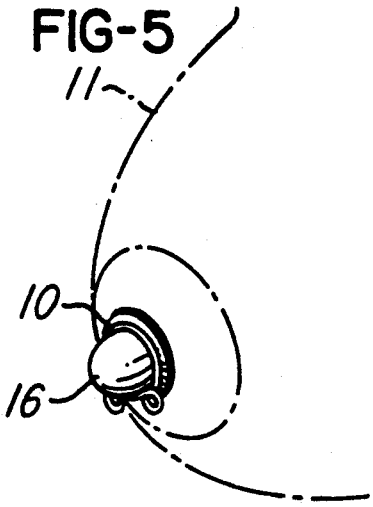
FIG. 5 is a view similar to FIG. 1 and showing the ring retaining a piece of material which covers the nipple portion of the breast shown in phantom.
Figure 6:
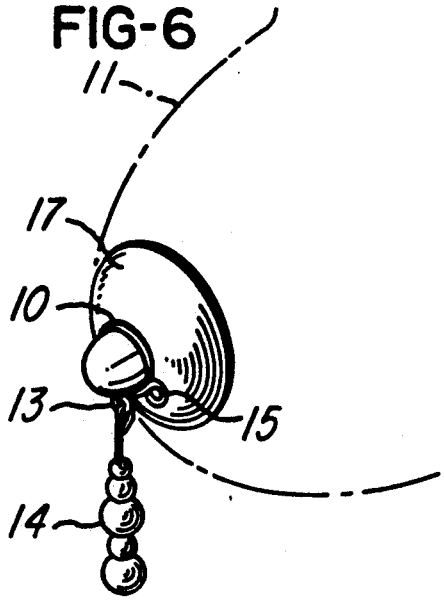
FIG. 6 is a view similar to FIG. 5 and wherein a piece of material covers the nipple and the immediate surrounding area.

Referring to FIG. 5, the nipple ring 10 surrounds a flexible or stretchable cover material 16 and holds the material on the nipple 12. FIG. 6 is similar to FIG. 5 and shows a flexible material 17, such as cloth, which is also held in position on the nipple 12 by means of the nipple ring 10 and covers the nipple and the surrounding area. FIG. 6 also shows the decorative jewelry item 14 hanging or depending from the circular end portion 13. In FIG. 5, the cover material 16 may be permanently attached to the nipple ring 10 for use in those areas where female breasts may be exposed except for the nipple itself. Similarly in FIG. 6, the flexible cloth or cover material 17 may be either placed over the nipple and held in place by the nipple ring 10 or may be permanently attached to the ring 10.

As mentioned above, the nipple ring is enlarged by manually squeezing the end portions 13 and 15 together. The ring 10 is then placed over the nipple 12 after which the pressure on end portions 13 and 15 is released so that the ring 10 reduces in diameter and snugly grips the nipple around the entire periphery of the nipple. Different size rings 10 are used for different sized nipples, for example, ranging from about 5 mm. to about 13 mm., and the rings may be made of a polished or otherwise decorative stainless steel or music wire or a carbon steel spring wire plated with a precious metal such as silver or gold to form a decorative ring. Other suitable spring-like materials may also be used for producing the nipple ring 10.

Figure 7:
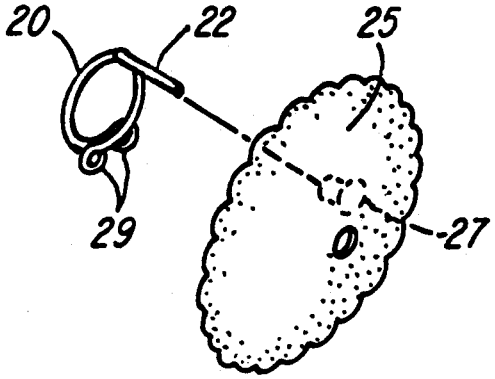
FIG. 7 is an exploded perspective view of a nipple ring and a decorative jewelry assembly in accordance with another embodiment of the invention.
Figure 8:
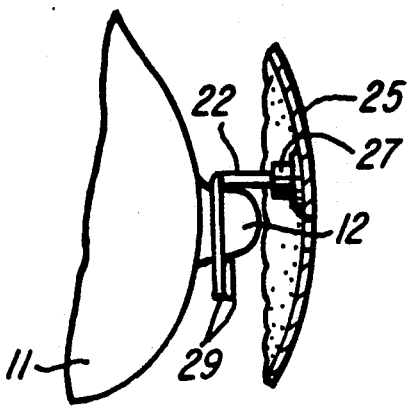
FIG. 8 is an elevational view, in part section, of the assembly shown in FIG. 7 and illustrating the mounting of the assembly on a nipple.

Referring to FIG. 7, a nipple ring 20 is constructed of a plated spring wire in the same manner as the nipple ring 10 described above but also includes a forwardly and axially projecting prong or pin 22. A decorative jewelry element 25, in the form of a cup-shaped body, includes an adhesively attached socket 27 molded of a resilient rubber-like material. The socket 27 receives the forward end portion of the projecting pin 22 and frictionally grips the removable pin so that when the ring 20 is mounted on a nipple 12, the decorative jewelry element 25 covers the nipple 12, as shown in FIG. 8. Preferably, the wire pin 22 is silver soldered to the wire nipple ring 20 and may be decorative plated in gold or silver along with the ring 20. As also shown in FIG. 7, the support pin 22 is anchored or welded to the ring 20 at a location diametrically opposed to the overlapping end portions 29 so that when the ring 20 is placed on a nipple 12, the pin 22 projects from the side of the nipple. The socket 27 is located eccentrically on the circular jewelry element 27 so that the center of the element 25 is aligned with the nipple 12.

Figure 9:
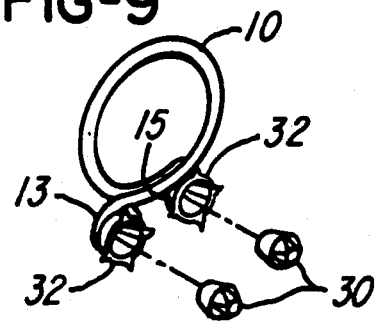
FIG. 9 is a perspective view of the nipple ring shown in FIG. 1 and illustrating an alternate attachment of decorative jewelry.

Referring to FIG. 9, the nipple ring 10 is decorated by a pair of reflective diamonds or stones 30 which are received within corresponding sockets 32 secured by silver solder to the opposite overlapping end portions 13 and 15 of the ring 10. The pair of stones 30 or other decorative elements may also be attached to the end portions 13 and 15 by other suitable means.

Figure 10:
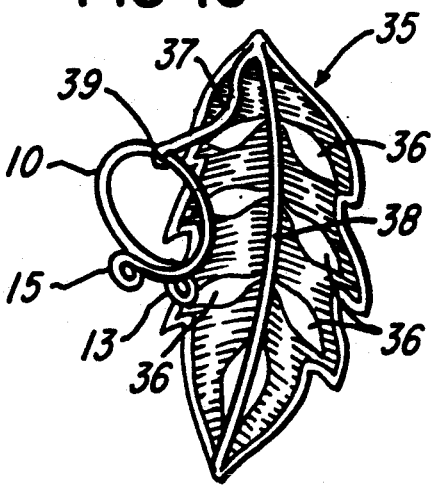
FIG. 10 is a perspective rear view of another assembly of the nipple ring and a decorative Jewelry item for covering the nipple.

Another form of decorative nipple cover is illustrated in FIG. 10. A decorative silk leaf 35 carries decorative jewelry 36 and is supported by a nipple ring 10 so that the leaf 35 covers the nipple in the same manner as the decorative jewelry element 25 described above in connection with FIGS. 7 and 8. The decorative leaf 35 is provided with a covered bendable support wire 37 which is formed as an extension of a covered center support wire 38. The support wire 37 projects downwardly and rearwardly from the upper end of the decorative leaf 35 and has an outer end portion 39 which wraps around the nipple ring 10 and is secured by glue.

From the drawings and the above description, it is apparent that a nipple ring constructed and used in accordance with the present invention provides desirable features and advantages. As a primary feature, the nipple ring of the invention provides for decorating a human breast without requiring piercing of the nipple and also provides for a positive and dependable retention of the decoration. In addition, the nipple ring may be conveniently attached to the nipple and removed from the nipple simply by expanding the nipple ring as shown in FIG. 3. The nipple ring may also be used for supporting different items of decorative jewelry, such as shown in FIGS. 1, 6, and 9 or for supporting a decorative element which covers the nipple, such as shown in FIGS. 7, 8 and 10.

While the forms of nipple ring herein described and their methods of use constitute preferred embodiments of the invention, it is to be understood that the invention is not limited to these precise forms and methods, and that changes may be made therein without departing from the scope and spirit of the invention as defined in the appended claims.

The invention having thus been described, the following is claimed:

1. A method of decorating a human breast having a projecting nipple, comprising the steps of forming an annular element of spring-like material and including a ring portion having a normal diameter slightly smaller than the size of the nipple and relatively movable opposite end portions, positioning the end portions to project outwardly from the ring portion, decorating the annular element, moving the end portions to enlarge the diameter of the ring portion, mounting the enlarged ring portion on the nipple, and releasing the end portions causing the ring portion to grip the nipple around the periphery of the nipple.

2. A method of decorating a human breast having a projecting nipple, comprising the steps of bending a predetermined length of metal wire to form a circular ring portion having a normal diameter slightly smaller than the size of the nipple and relatively movable and outwardly projecting overlapping end portions, decorating the ring portion, compressing the end portions together to enlarge the diameter of the ring portion, mounting the enlarged ring portion on the nipple, and releasing the end portions causing the ring portion to grip the nipple around the periphery of the nipple.

3. A method of decorating a human breast having a projecting nipple, comprising the steps of forming an annular element of spring-like material and including a ring portion having a normal diameter slightly smaller than the size of the nipple and relatively movable opposite end portions, positioning the end portions to project outwardly from the ring portion, attaching a plurality of circumferentially spaced decorative jewelry articles to the annular element, moving the end portions to enlarge the diameter of the ring portion, mounting the enlarged ring portion on the nipple, and releasing the end portions causing the ring portion to grip the nipple around the periphery of the nipple.

4. A method of decorating a human breast having a projecting nipple, comprising the steps of forming an annular element of spring-like material and including a circular ring portion having a normal diameter slightly smaller than the size of the nipple and relatively movable and outwardly projecting overlapping end portions, attaching to the ring portion a decorative cover element spaced axially from the ring portion and positioned to cover the nipple, compressing the end portions together to enlarge the diameter of the ring portion, mounting the enlarged ring portion on the nipple, and releasing the end portions causing the ring portion to grip the nipple around the periphery of the nipple.

* * * * *